US008286374B2

(12) United States Patent
Dilworth et al.

(10) Patent No.: US 8,286,374 B2
(45) **Date of Patent: *Oct. 16, 2012**

(54) PLOW SYSTEMS FOR NON-HIGHWAY VEHICLES

(75) Inventors: Michael Dilworth, Muskego, WI (US); Brad Fromm, Franklin, WI (US)

(73) Assignee: Mibar Products, Ltd., Oak Creek, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/116,832

(22) Filed: May 26, 2011

(65) Prior Publication Data

US 2011/0225853 A1 Sep. 22, 2011

Related U.S. Application Data

(63) Continuation of application No. 11/843,321, filed on Aug. 22, 2007, now Pat. No. 7,975,407, which is a continuation-in-part of application No. 11/513,879, filed on Aug. 31, 2006.

(51) Int. Cl.
*E01H 5/04* (2006.01)

(52) U.S. Cl. ..... 37/231

(58) Field of Classification Search ..... 37/219, 37/231, 236, 266; 172/811, 828
See application file for complete search history.

(56) References Cited

U.S. PATENT DOCUMENTS 2,073,391 A * 3/1937 Greene ..... 172/828
2,991,566 A 7/1961 Sumner et al.
5,615,745 A 4/1997 Cross
5,832,637 A 11/1998 Aguado et al.
5,950,336 A 9/1999 Liebl
5,967,241 A 10/1999 Cross et al.
5,987,785 A 11/1999 Aguado et al.
6,178,668 B1 1/2001 Gustafson et al.
6,334,269 B1 1/2002 Dilks
6,618,964 B2 * 9/2003 Kost et al. ..... 37/231
6,711,837 B2 3/2004 Bloxdorf et al.
6,732,811 B1 5/2004 Elliott
6,817,118 B2 11/2004 Schmeichel
6,843,002 B1 1/2005 Moffitt
6,927,513 B2 8/2005 Schreier
6,931,770 B2 8/2005 Belzile
6,957,505 B1 10/2005 Moffitt
6,964,121 B2 11/2005 Harris
7,093,381 B2 8/2006 Belzile
7,131,221 B2 11/2006 Schmeichel
(Continued)

OTHER PUBLICATIONS

J. R. Graham Power Sports Warehouse 2005 Off-Road Dirt Bike & ATV Parts and Accessories Catalog, pp. 79-86.

*Primary Examiner* — Thomas B Will
*Assistant Examiner* — Mai Nguyen
(74) *Attorney, Agent, or Firm* — Boyle Frederickson, S.C.

(57) ABSTRACT

Non-highway vehicle plowing systems are described. The plowing system includes a mount assembly having a lower mount bracket, a plow mount bracket, an upper mount bracket, and an actuator bracket. The lower mount bracket is attached to the non-highway vehicle and the plow mount bracket is pivotably connected to the lower mounting bracket. The upper mount bracket is also secured to the non-highway vehicle and is constructed to engage the actuator bracket at a plurality of positions thereby allowing the plow mount assembly to be operable with a plurality of non-highway vehicles. The systems provide advantages in that the systems are not vehicle specific and are adaptable to different vehicle structures.

13 Claims, 8 Drawing Sheets

U.S. PATENT DOCUMENTS

| | | | |
|---|---|---|---|
| 7,219,453 | B2 | 5/2007 | Baker |
| 2004/0205985 | A1 | 10/2004 | Schmeichel |
| 2005/0066554 | A1 | 3/2005 | Schmeichel |
| 2006/0005433 | A1 | 1/2006 | Curtis et al. |
| 2007/0056192 | A1 | 3/2007 | Schmeichel |
| 2007/0056193 | A1 | 3/2007 | Schmeichel |
| 2007/0056194 | A1 | 3/2007 | Schmeichel |
| 2007/0056195 | A1 | 3/2007 | Schmeichel |
| 2007/0056196 | A1 | 3/2007 | Schmeichel |
| 2007/0062071 | A1 | 3/2007 | Schmeichel |
| 2007/0062072 | A1 | 3/2007 | Schmeichel |
| 2007/0062073 | A1 | 3/2007 | Schmeichel |
| 2007/0062074 | A1 | 3/2007 | Schmeichel |
| 2007/0084090 | A1 | 4/2007 | Schmeichel |
| 2007/0101620 | A1 | 5/2007 | Roy |
| 2007/0151127 | A1 | 7/2007 | Schmeichel |
| 2008/0053673 | A1 | 3/2008 | Dilworth et al. |

* cited by examiner

PLOW SYSTEMS FOR NON-HIGHWAY VEHICLES

CROSS-REFERENCE TO RELATED APPLICATIONS

This application is a continuation of and claims priority to both allowed U.S. patent application Ser. No. 11/843,321 filed on Aug. 22, 2007 now U.S. Pat No. 7,975,407 and which is a continuation-in-part of pending U.S. application Ser. No. 11/513,879 titled "Plow Systems for Non-Highway Vehicles" filed on Aug. 31, 2006, the disclosures of both of which are incorporated herein.

BACKGROUND OF THE INVENTION

1. Field of the Invention

The present invention relates generally to the field of plowing systems and, more particularly, to a plow system for non-highway vehicles. Specifically, a preferred embodiment of the present invention relates to an all terrain vehicle or an "ATV" plowing system.

2. Discussion of the Related Art

ATV's and other non-highway type vehicles are frequently constructed for versatility, utility, and recreation. That is, where some users frequently use the non-highway type vehicles for recreational non-highway transportation, other users utilize such equipment for more utilitarian purposes. Hunters, ranchers, farmers, and tradesman frequently have one or more such vehicles to facilitate transportation across non-paved and relatively rugged landscapes. Such equipment is commonly equipped with plowing attachments to remove debris, e.g., snow from areas where other traditional highway-type plow-equipped vehicles cannot otherwise travel due to terrain or weight restrictions.

Known plow assemblies come in a variety of shapes, sizes, and configurations. Such plow assemblies commonly include a plow which is pivotably attached to an ATV. Here, a hand-actuated lever may extend from the plow such that, during operation, an operator must manually raise and/or lower the plow via the handle. This configuration requires the operator to remove a hand from the steering and control mechanism of the all terrain vehicle to manipulate the handle attached to the plow. Accordingly, it is often problematic for the operator to concurrently steer and raise and/or lower the plow assembly. Furthermore, such configurations require the operator have a sufficient amount of strength to raise the plow assembly from its normal lowered operating position. Such a configuration prevents certain operators from performing the plowing-type operation with the ATV equipped plow.

Still other configurations are designed so the plow assembly is raised and/or lowered via actuation of a winch attached to the all terrain vehicle. Although such assemblies overcome the aforementioned drawbacks of the handle-actuated plow assembly, they are not without their own respective drawbacks. Such systems require the addition of a winch to the ATV. Accordingly, such systems increase the cost associated with the plow system. Furthermore, although the winch provides upward pressure to raise the plow from an operating position, the weight of the plow is the only down pressure generated by such assemblies. Therefore, such systems are prone to "ride up" on a plowed material. That is, when traversing uneven terrain or plowing substantial amounts of snow, the plow has a tendency to raise up above a desired plow level. Even further, the winch utilized to raise and/or lower the plow assembly is commonly geared to provide slow cable translation relative to the amount of pull force generated by the winch. Accordingly, raising and/or lowering the plow assembly is time consuming and increases the time required for a given plowing operation.

Still other ATV plow assemblies provide an actuator manipulated plow assembly. Although such systems overcome the drawbacks associated with the lack of down pressure of the winch plow assembly previously described, such systems also present their own relative deficiencies. Such assemblies are frequently tailored to specific all terrain vehicles. That is, a mounting kit specific to any particular vehicle must often be purchased in order to adapt the actuator manipulated plow assembly for connection to a specific all terrain vehicle. Accordingly, such systems increase the user and manufacturer cost associated with such systems. Furthermore, where a user has more than one all terrain vehicle, an ATV plowing assembly adapted for each vehicle must be purchased. Still further, were a user to purchase a new all terrain vehicle, an already owned plow assembly may not be connectable to the new all terrain vehicle.

Regardless of whether the plow is handle, winch, or electric/hydraulic actuator actuated as previously described, these systems suffer from a further drawback. The systems have the plow attached to the all terrain vehicle via a relatively rigid, albeit pivotable, plow mount assembly. That is, although the plow is pivotably attached to the all terrain vehicle, such systems do not address impact moments and discontinuities experienced by the plow and plow mount as the plow and all terrain vehicle traverse uneven terrain. When such plows are in a lowered position, discontinuities in the plowed terrain are translated directly through the plow mount to the all terrain vehicle. Such rigid connections translate the upward and downward pressures inflicted upon the plow directly to the all terrain vehicle. If the plow traverses terrain and rides up, it has a tendency to raise the front wheels of the all terrain vehicle, thereby negatively affecting the traction of the all terrain vehicle. As the all terrain vehicle traverses terrain with the plow in a raised position, even though the suspension of the all terrain vehicle may absorb some impacts of the terrain, the plow, being rigidly connected thereto, accentuates the bounce of the plow and translates it directly to the ATV. Accordingly, such assemblies detract from a user's comfort during a plowing operation, increase the time required for a plowing operation, or fail to adequately remove the plowed material from the terrain. Such systems also may not adequately deal with stress and strain put on the actuator and mounting assembly.

Therefore, it would be desirable to provide an all terrain vehicle plowing system that absorbs impacts as the system traverses terrain, is simple to use and/or operate, and is constructed to be connected to a plurality of all terrain vehicle constructions.

SUMMARY OF THE INVENTION

The present invention is directed to a plow mount system that overcomes the aforementioned problems. The plowing system includes a mount assembly having a lower mount bracket, a plow mount bracket, an upper mount bracket, and an actuator bracket. The lower mount bracket is attached to the non-highway vehicle and the plow mount bracket is pivotably connected to the lower mounting bracket. The upper mount bracket is also secured to the non-highway vehicle and is constructed to engage the actuator bracket at a plurality of positions thereby allowing the plow mount assembly to be operable with a plurality of non-highway vehicles. The systems provide advantages in that the systems are not vehicle specific and are adaptable to different vehicle structures.

One aspect of the present invention discloses providing a plowing system that is securable to any of a number of vehicle configuration.

Another aspect of the invention discloses providing a plow system that can be independently configurable to accommodate operation of the plow system with one or more vehicle configurations A further aspect of the invention includes various means of simply and efficiently configuring the plowing system for operation with any of the number of vehicle constructions.

Yet another aspect of the invention discloses a plowing system that is configured to provide positive upward and downward pressure to a plow blade associated with the plowing system.

An even further aspect of the invention includes providing a shock arresting system for absorbing impacts generally associated with operation of the plow system over obstructions or other uneven terrain.

A plowing system in accordance with one or more of the above aspects provides a plowing system that is operable with various vehicle configurations, is robust, exhibits desirable attributes during plowing operations, can be quickly and efficiently integrated into a variety of vehicle configurations, and is simple and enjoyable to operate.

These, and other aspects and advantages of the present invention will be better appreciated and understood when considered in conjunction with the following description and the accompanying drawings. It should be understood, however, that the following description, while indicating preferred embodiments of the present invention, is given by way of illustration and not of limitation. Many changes and modifications may be made within the scope of the present invention without departing from the spirit thereof, and the invention includes all such modifications.

BRIEF DESCRIPTION OF THE DRAWINGS

A clear conception of the advantages and features constituting the present invention, and of the construction and operation of typical mechanisms provided with the present invention, will become more readily apparent by referring to the exemplary, and therefore non-limiting, embodiments illustrated in the drawings accompanying and forming a part of this specification, wherein like reference numerals designate the same elements in the several views, and in which.

Figure 1:
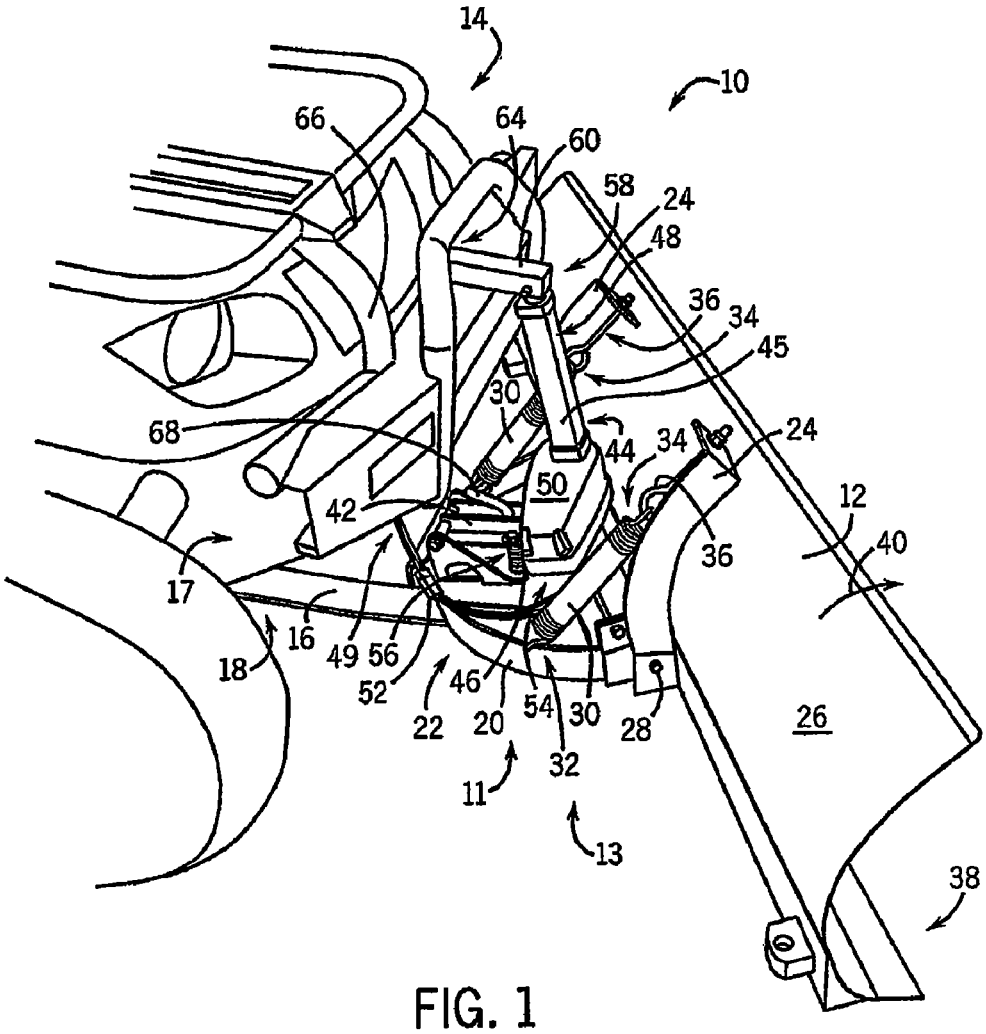
FIG. 1 is a perspective view of a plowing system according to one embodiment of the present invention.

In describing the various preferred embodiments of the invention which are illustrated in the drawings, specific terminology is resorted to for the sake of clarity. However, it is not intended that the invention be limited to the specific terms so selected and it is to be understood that each specific term includes all technical equivalents which operate in a similar manner to accomplish a similar purpose. For example, the words connected, secured, attached or terms similar thereto are often used. They are not limited to direct connection unless otherwise specified but include connection through other elements where such connection is recognized as being equivalent by those skilled in the art.

DESCRIPTION OF PREFERRED EMBODIMENT

FIG. 1 shows a plowing system and plow mount system 13 according to one embodiment of the present invention. Preferably, plowing system 10 includes a plow blade or plow 12 pivotably connected to an all terrain vehicle (ATV) 14. As used herein, ATV means an engine-driven device which is designed to travel on three or more low-pressure tires on primarily non-highway terrain. Although many ATV's have a net weight of approximately less than 1,000 pounds, as used herein, ATV includes what is commonly referred to as UTV's or utility type vehicles having attributes that are similar to both traditional recreation use ATV's and off-road work vehicles. Such utility type vehicles can include large cargo areas, dump boxes, or the like, and often include side-by-side seating. These vehicles also can commonly exceed weights of 1,000 pounds. Understandably, as used herein, ATV, UTV, and non-highway vehicles are synonymous with such non-highway vehicles that include: three-wheelers, four-wheelers and amphibious vehicles, such as six-wheel and eight-wheel non-highway type vehicles as well as other non-highway utility vehicles.

Plowing system 10 preferably includes a plow mount system, for example, a lower mount bracket assembly or lower mount assembly 11 that includes a first member, first bracket, or frame bracket 16. A first end 18 of frame bracket 16 is attached to all terrain vehicle 14. Preferably frame bracket 16 is secured to a body or frame 17 of all terrain vehicle 14 or other structure, such as brush guards and the like secured directly thereto. Lower mount assembly 11 includes a second member, second bracket, or plow bracket 20 that is rotationally connected to frame bracket 16 proximate a second end 22 thereof.

Plow 12 includes a pair of ribs 24, which extend from a rear surface 26 of plow 12. A pin 28 passes through each of ribs 24 and pivotably attaches plow 12 to plow bracket 20. Each of a pair of springs 30 has a first end 32, which is connected to plow bracket 20, and a second end 34, which engages an adjustable connector, eye-bolt, or bolt 36. Each bolt 36 is adjustably connected to one of ribs 24 such that the tension of springs 30 can be adjusted. Springs 30 maintain plow 12 in a generally upright position unless an immovable obstruction is encountered by a blade edge 38 of plow 12 during a plowing operation. When blade edge 38 impacts an immovable obstruction, springs 30 deflect, thereby allowing plow 12 to roll, in a direction indicated by arrow 40, to minimize operator sensing of the impact and allowing plow 12 to snugly deflect about the immovable obstruction.

Lower mount assembly 11 of plow system 10 includes an intermediate bracket, or a third bracket 42 pivotably connected to frame bracket 16. An actuator assembly 44 is connected to third bracket 42. An absorber, arrestor, or shock arrestor 46 is connected to third bracket 42 between actuator assembly 44 and the pivotable connection of third bracket 42 to frame bracket 16. Shock arrestor 46 dampens movement between the vehicle and plow 12. Actuator assembly 44 presently includes an actuator 45, an extendable ram or ram 48 and a driving means, such as a pump, motor, or actuator motor 50. Actuator motor 50 is operatively connected to a power system 49 of ATV 14 via connector 52. Connector 52 extends to the controls of ATV 14, thereby allowing the operator of the ATV to control the operation of actuator motor 50 and thereby the positioning of plow 12.

An actuator first end 54 of actuator 45 is pivotably attached to lower mount assembly 11 proximate one or a first end 56 of third bracket 42. Another or second end 58 of actuator 45 is pivotably connected to an actuator bracket 60. As shown in FIG. 1, a first end 62 of actuator bracket 60 is pivotably connected to second end 58 of actuator 45, and a second end 64 of actuator bracket 60 is rigidly connected to ATV 14. Preferably, the second end 64 is also securely connected to a frame member 66 of ATV 14. During operation of actuator motor 50, ram 48 extends and retracts in response to the operator inputs communicated to actuator assembly through connector 52. When ram 48 is located in an extended position, plowing system 10 applies a down pressure at blade edge 38 of plow 12. When an operator desires to raise the plow, ram 48 of actuator assembly 44 is retracted, thereby raising leading edge 38 of plow 12 from a ground surface.

As shown in FIG. 1, plow 12 is also pivotably connected to ATV 14 to allow plow 12 to be pitched relative to a direction of travel of the ATV. A pitch pin 68 is disposed between third brackets 42, passes through plow bracket 20 and engages frame bracket 16, thereby securing the angled position of plow 12 relative to ATV 14. Pitch pin 68 is manually operable to allow an operator, upon releasing pitch pin 68, to manually pivot plow 12 relative to frame bracket 16, thereby allowing plow 12 to be conveniently oriented at a plurality of application specific pitches without altering the construction of the components of mount assembly 11. Such a construction allows snow to be plowed to alternating sides of the ATV rather than simply in the direction of travel of the ATV.

Figure 2:
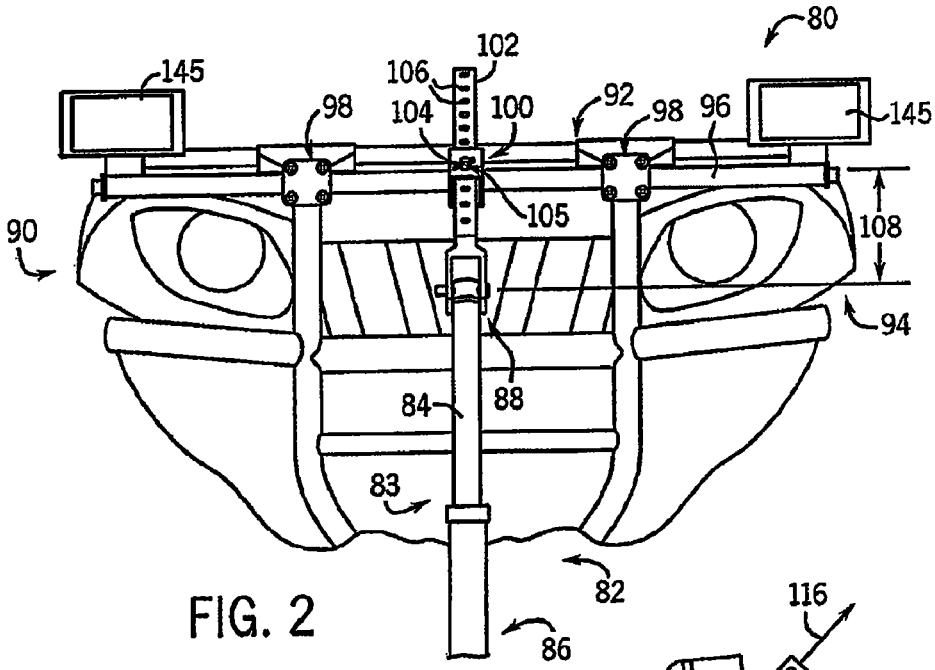
FIG. 2 is an elevational end view of another embodiment of a plowing system in accordance with the present invention.

FIG. 2 shows another plowing system 80 according to the present invention. Plowing system 80 includes an actuator assembly 82 having a powered actuator or actuator 83 and an extendable ram 84 connected thereto. A first end 86 of actuator assembly 82 is connected to a lower mount bracket assembly or lower mount assembly 112 substantially similar to lower mount assembly 11 shown in FIG. 1. A second end 88 of actuator assembly 82 is pivotably connected to a mount bracket or variable position upper mount assembly 90. Upper mount assembly 90 includes an actuator bracket mount or upper mount bracket assembly 92 constructed to engage an ATV 94 independent of the particular construction of ATV 94. Upper mount bracket assembly 92 includes a crossbar 96 and a pair of frame connectors 98. Crossbar 96 includes an actuator bracket pocket 100 constructed to slidably engage an offset bracket or actuator bracket 102. A pin 104 is constructed to pass through an opening or passage 105 formed through actuator bracket pocket 100 of crossbar 96 and removably engage a plurality of openings 106 formed in actuator bracket 102. Such a construction defines a variable offset 108 between second end 88 of actuator assembly 82 and ATV 94.

Figure 3:
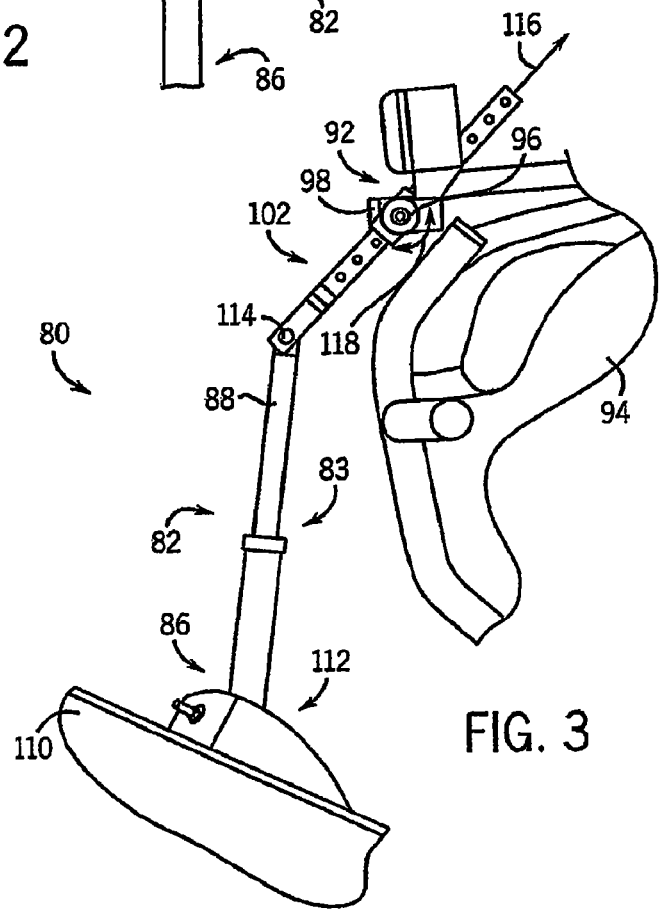
FIG. 3 is an elevational side view of the plowing system shown in FIG. 2.

FIG. 3 shows an elevational view of the plowing system 80 shown in FIG. 2. Plowing system 80 includes a plow 110 connected to first end 86 of actuator assembly 82 and pivotably connected to ATV 94 via a lower mount assembly 112, which is substantially similar to lower mount assembly 11 shown in FIG. 1. Second end 88 of actuator assembly 82 is pivotably connected to actuator bracket 102 via a removable connector, such as a pin 114. Actuator bracket 102 is linearly translatable about an axis, indicated by arrow 116, relative to upper mount bracket assembly 92 thereby allowing connection of actuator bracket 102 to ATV 94 at a plurality of positions. Crossbar 96 is rotatable, indicated by arrow 118, relative to frame connectors 98, thereby rotating axis 116 of actuator bracket 102 about the axis of crossbar 96. Such a construction allows plow system 10 to connect to a variety of all terrain vehicles independent of the specific frame construction of the all terrain vehicle. Additionally, such construction allows plow system 10 to be configured for operation when the other systems of the ATV are reconfigured. For example, suspension components such as shocks, springs, or tires can be varied to achieve a desired ride or suspension configuration of the ATV and plow system 10 would still be operable with the ATV. Accordingly plowing system 80 is highly versatile and functional with ATV's constructed by different manufacturers and/or having different front end/frame assemblies, sub-assemblies as between different model years from a common manufacturer.

Figure 4:
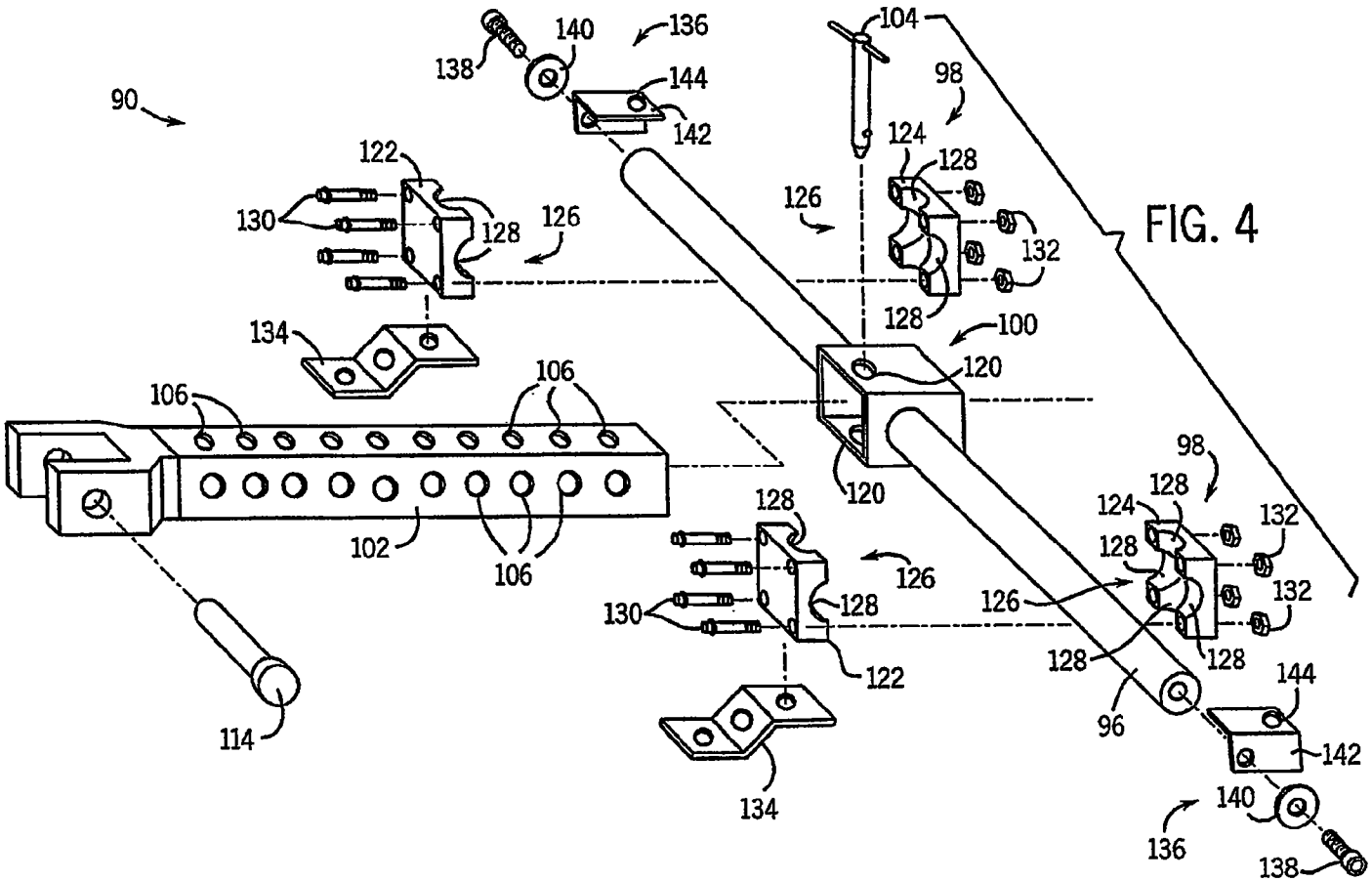
FIG. 4 is a perspective exploded view of a portion of the plowing system shown in FIG. 3.

FIG. 4 shows upper mount assembly 90 and actuator bracket 102 removed from an ATV. Crossbar 96 includes actuator bracket pocket 100 generally centrally disposed thereon. Actuator bracket pocket 100 includes a pair of openings 120 formed therein constructed to engage pin 104. Actuator bracket 102 is slidably positionable within actuator bracket pocket 100 of crossbar 96 such that a respective pair of openings 106 align with openings 120 so that pin 104 can pass therethrough, thereby securing actuator bracket 102 to crossbar 96. Upper mount assembly 90 includes a plurality of frame connectors 98. Each frame connector 98 includes a front connector 122 and a rear connector 124. An inside surface 126 of each front connector 122 and rear connector 124 includes a plurality of arcuate surfaces 128. Arcuate surfaces 128 are constructed to snugly engage crossbar 96 when front connector 122 and rear connector 124 are secured together via a plurality of fasteners 130 and associated nuts 132. A connector bracket 134 is constructed to be secured to each of frame connectors 98 and engaged with a frame of an ATV. Frame connectors 98 and connector brackets 134 cooperatively allow upper mount assembly 90 to be secured to a plurality of ATV frame constructions.

Upper mount assembly 90 includes an optional light mount assembly 136 disposed at generally opposite ends of crossbar 96. Light mount assemblies 136 are secured to crossbar 96 via a fastener 138 and an associated washer 140. Each light mount assembly includes a light bracket 142 having an opening 144 formed therein and constructed to engage a light element 145, as shown in FIG. 2. As shown in FIG. 2, optional light mount assembly 136 mounts to light element 145 above the raised operating position of the plow attached thereto, thereby allowing night time utilization of plowing systems 10, 80. Preferably, light brackets 142 are secured to crossbar 96 to allow independent positioning of the individual lights connected to the cross-bar.

Figure 5:
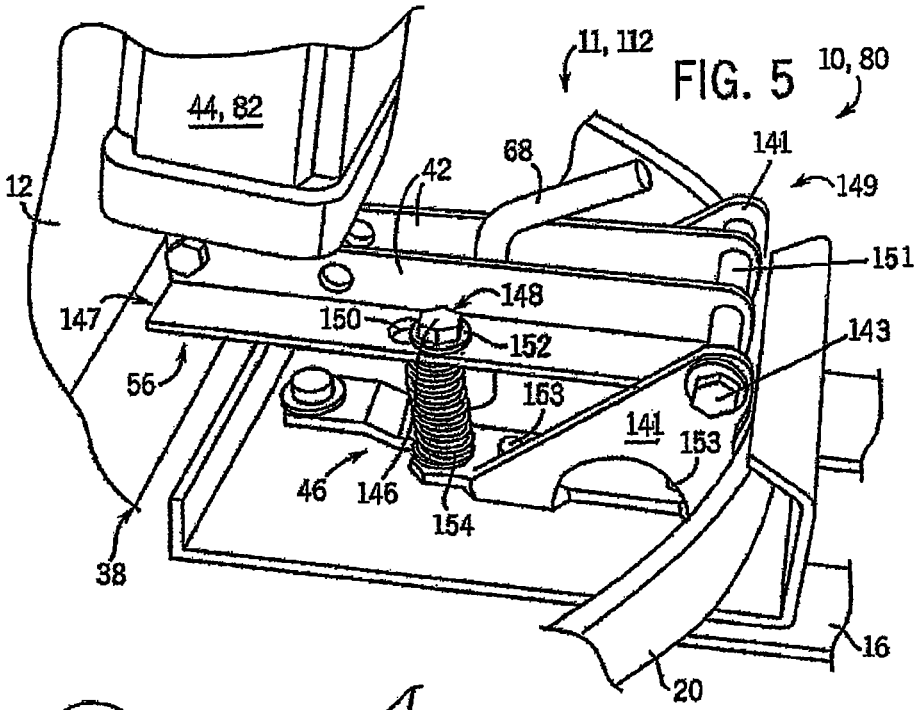
FIG. 5 is a perspective view of a shock arrestor of the plowing systems shown in FIG. 1 or FIG. 2.
Figure 6:
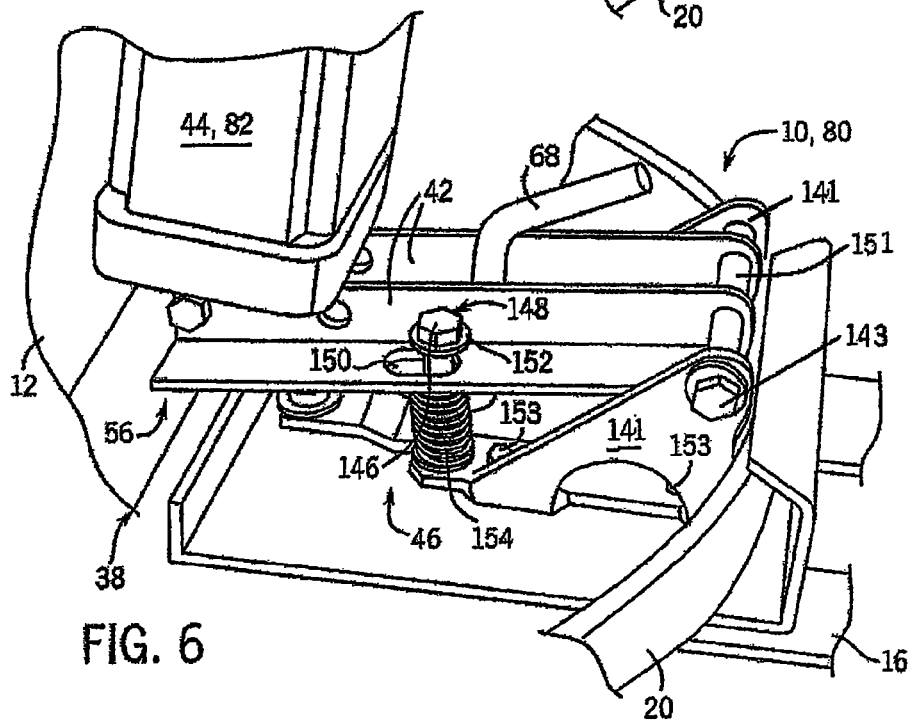
FIG. 6 is a perspective view similar to FIG. 5 with the shock arrestor deflected to an alternate position.

FIGS. 5 and 6 show the arrestor of plow systems 10, 80. Third brackets 42 are pivotably attached to a pair of extension brackets 141 by a fastener 143 that passes through an optional sleeve 151 and pivotably secures third brackets 42 to extension brackets 141. A plurality of fasteners 153 pass through corresponding openings in the extension bracket 141 and secure the extension brackets 141 to frame brackets 16. Extension brackets 141 allow third brackets 42 to move relative to frame bracket 16.

As shown in FIG. 5, arrestor 46 includes a support pin or pin 146, which is connected between third brackets 42 and plow bracket 20. Each third bracket 42 has one end 147 pivotable connected to first end 56 of actuator assembly 44, 82 and another end 149 pivotable connected to lower mount assembly 11, 112. Each pin 146 includes a head 148 positioned proximate each third bracket 42. Each pin 146 passes through an opening 150 formed in each of third brackets 42. A washer 152 is disposed between third bracket 42 and head 148 of arrestor pin 146 and protects head 148 from interfering with movement of third bracket 42.

As shown in FIG. 5, when cutting edge 38 is lowered to a desired operating position or plow 12 is raised above a terrain, third brackets 42 are maintained in close proximity to head 148 of arrestor 46 by the weight of plow 12 and by a spring 154. As shown in FIG. 6, when plow 12 encounters an obstruction during a plowing operation, plow bracket 20 deflects upwardly, thereby compressing spring 154 between plow bracket 20 and third brackets 42. As shown in FIGS. 5 and 6, pin 146 defines a maximum distance between third brackets 42 and frame bracket 16, and spring 154 defines a minimum distance therebetween. Accordingly, arrestor 46 allows plow 12 and plow bracket 20 to move independent of actuator 45. Such a construction reduces the impact of an obstruction that is translated through plowing systems 10, 80 to the frame of the ATV connected thereto. Similarly, when in a raised position, arrestor 46 dampens vibrational "bounce" of plow 12 as all terrain vehicle moves across uneven terrain. Such a construction minimizes the effects of plow bounce during non-operational transportation of the plow, as well as operational impacts subjected to the plow thereby reducing operator fatigue during a plowing process. Accordingly, arrestor 46 reduces the potential of damaging plow system 10, lower mount assemblies 11, 112, actuator assembly 44, 82, and upper mount assembly 90, or ATV 14 from plow impacts.

Figure 7:
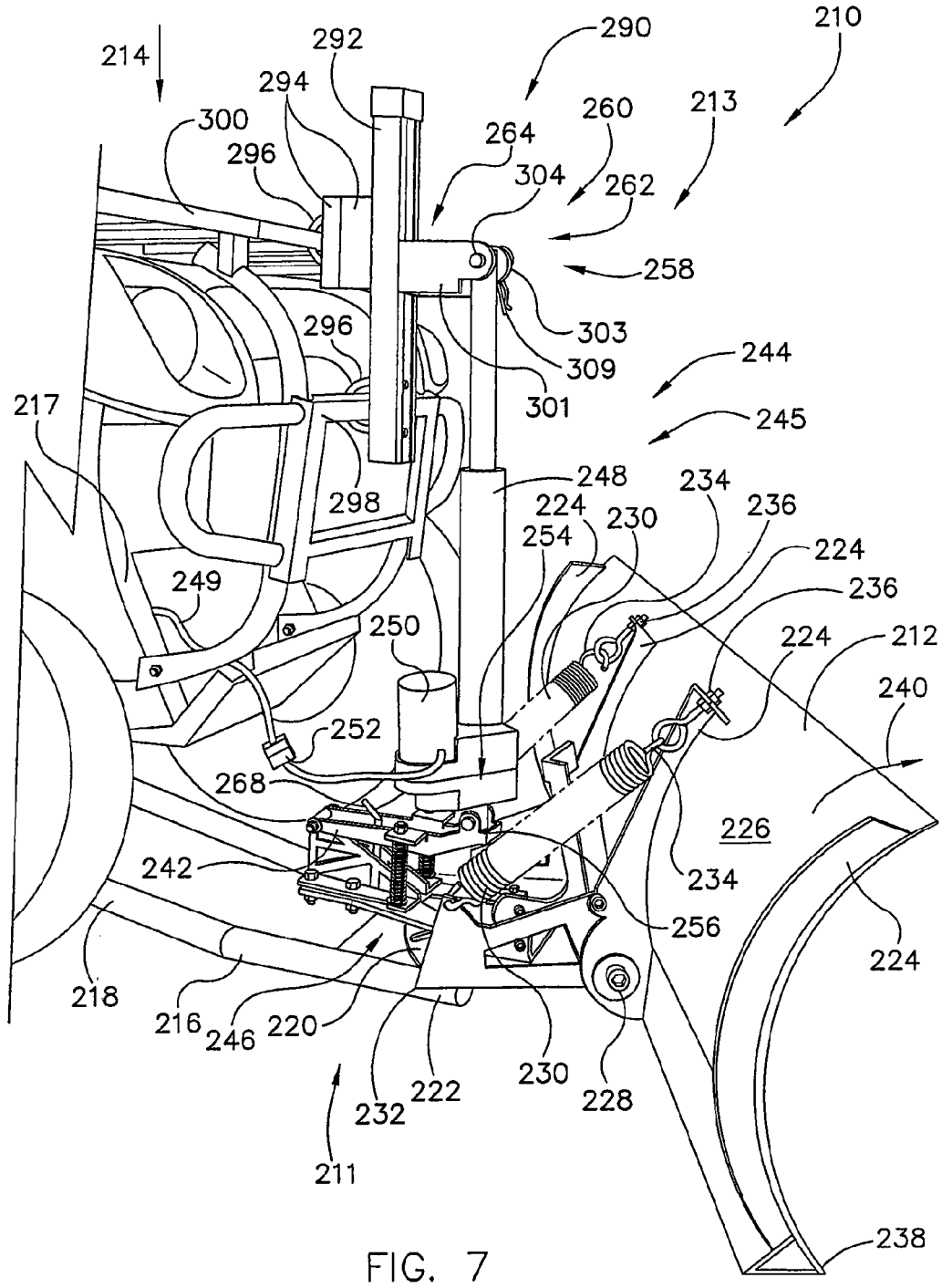
FIG. 7 is a perspective view of a plowing system according to yet another embodiment of the present invention.

FIG. 7 shows a plowing system 210 and plow mount system 213 according to a further embodiment of the present invention. Preferably, plowing system 210 includes a plow blade or plow 212 pivotably connected to a non-highway vehicle such as an all terrain vehicle (ATV) 214. Plowing system 210 includes a plow mount system 213 having a lower mount bracket assembly or lower mount assembly 211 that includes a first member, first bracket, or frame bracket 216. A first end 218 of frame bracket 216 is attached to all terrain vehicle 214. Preferably frame bracket 216 is secured to a body or frame 217 of all terrain vehicle 214 or other structure, such as brush guards and the like that are secured directly to frame 217. Lower mount assembly 211 includes a second member, second bracket, or plow bracket 220 that is rotationally connected to frame bracket 216 proximate a second end 222 thereof.

Plow 212 includes a number of ribs 224, which extend from a rear surface 226 of plow 212. A pin 228 passes through each of the interior oriented ribs 224 and pivotably attaches plow 212 to plow bracket 220. Each of a pair of springs 230 has a first end 232, which is connected to plow bracket 220, and a second end 234, which engages an adjustable connector, eyebolt, or bolt 236. Each bolt 236 is adjustably connected to one of ribs 224 such that the tension of springs 230 can be adjusted. Springs 230 maintain plow 212 in a generally upright position unless an immovable or otherwise rigid obstruction is encountered by a cutting or blade edge 238 of plow 212 during a plowing operation. When blade edge 238 impacts an immovable obstruction, springs 230 deflect, thereby allowing plow 212 to roll, in a direction indicated by arrow 240. Springs 230 allow plow 212 to snugly deflect about the obstruction and reduce operator sensing of the impact.

Lower mount assembly 211 of plow system 210 includes an intermediate bracket, or a third bracket 242 that is pivotably connected to frame bracket 216. An actuator assembly 244 is connected to third bracket 242. As described further with respect to FIGS. 11 and 12, an absorber, arrestor, or shock arrestor 246 is connected to third bracket 242 at a position generally between the engagement of actuator assembly 244 and the pivotable connection to frame bracket 216 with third bracket 242. Shock arrestor 246 dampens the communication of movement forces between vehicle 214 and plow 212.

Actuator assembly 244 includes an actuator 245, an extendable ram or ram 248 and a driving means, such as a pump, motor, or actuator motor 250. Actuator motor 250 is operatively connected to a power system 249 of ATV 214 via connector 252. Control of actuator motor 250 is communicated toward the controls of ATV 214, generally associated with a handlebar or handlebar area, and thereby allows the operator of the ATV to control the operation of actuator motor 250 from a position seated atop ATV 214. As described further below, operation of actuator motor 250 manipulates the length of ram 248 thereby manipulating the positioning of plow 212.

A first end 254 of actuator 245, or actuator first end 254, is pivotably attached to lower mount assembly 211 proximate a first end 256 of third bracket 242. Another or second end 258 of actuator 245 is pivotably connected to an actuator bracket 260 of a variable position upper mount assembly 290. As shown in FIG. 7, a first end 262 of actuator bracket 260 is pivotably connected to second end 258 of actuator 245 and a second end 264 of actuator bracket 260 is attached to upper mount assembly 290.

During operation of actuator motor 250, ram 248 extends and retracts in response to the operator inputs communicated to actuator assembly through connector 252. When ram 248 is located in an extended position, plowing system 210 applies a down pressure at blade edge 238 of plow 212. When an operator desires to raise the plow, ram 248 of actuator assembly 244 is retracted, thereby raising blade edge 238 of plow 212 from a ground surface.

As shown in FIG. 7, plow 212 is also pivotably connected to ATV 214 to allow plow 212 to be pitched relative to a direction of travel of the ATV. A pitch pin 268 is disposed between third brackets 242, passes through plow bracket 220 and engages frame bracket 216, thereby securing the angled position of plow 212 relative to ATV 214. Pitch pin 268 is manually operable to allow an operator, upon releasing pitch pin 268, to manually pivot plow 212 relative to frame bracket 216, thereby allowing plow 212 to be conveniently oriented at a plurality of application specific pitches without altering the construction of the components of plow mount assembly 213. Such a construction allows snow to be plowed to alternating sides of the vehicle rather than simply in the direction of travel of ATV 214.

Figure 8:
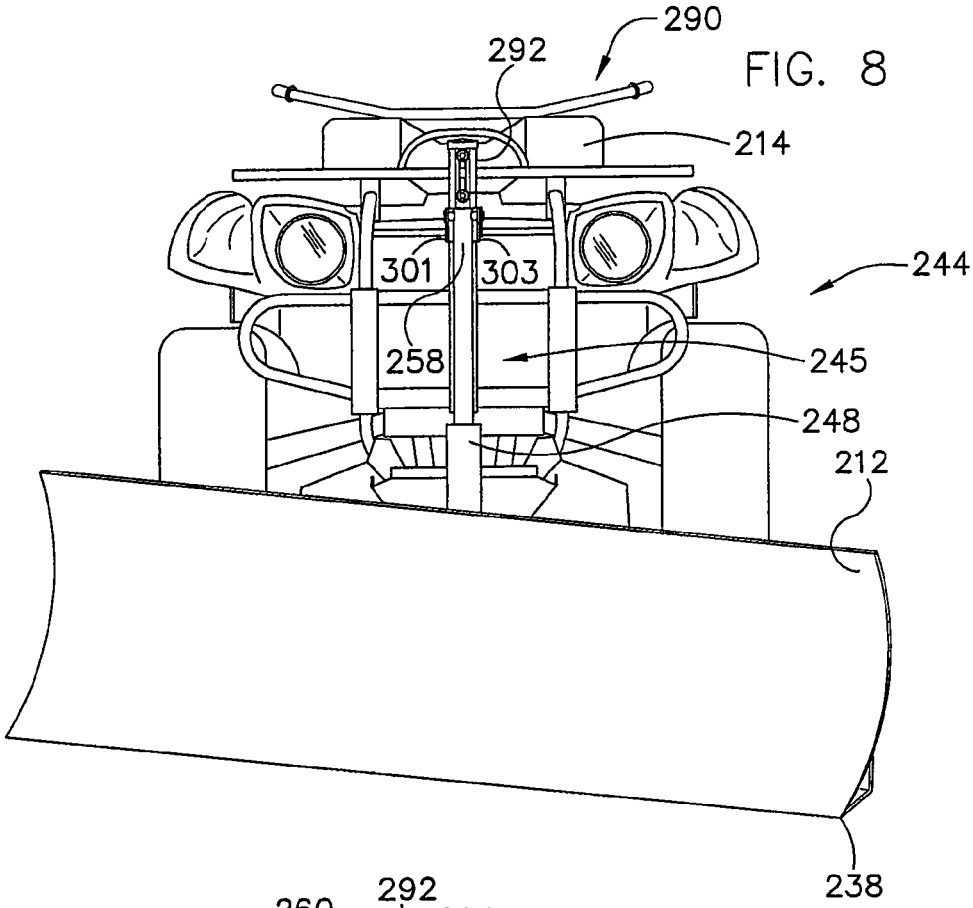
FIG. 8 is a front elevational view of the plowing system shown in FIG. 7.

Referring to FIGS. 7 and 8, upper mount assembly 290 includes a mount bracket or rail 292 constructed to engage an ATV 214 generally independent of the particular construction of ATV 214. Upper mount assembly 290 includes a number of optional spacers 294 and a pair of fasteners 296 that cooperate with spacers 294 to secure rail 292 to the frame of the ATV, a frame connected member, such as a brush guard 298, a pack rack 300, or like structure. Preferably, fasteners 296 are generally U-shaped and cooperate with spacers 294 to maintain rail 292 in a generally vertical orientation relative to ATV 214.

Understandably, spacers 294 and fasteners 296 may be provided with other relative constructions ad/or thicknesses to maintain rail 292 in any desired orientation with respect to any of a number of vehicle constructions and configurations.

Actuator bracket 260 includes a pair of arms 301, 303 that are positioned on generally opposite sides of second end 258 of actuator 245. Each arm 301, 303 includes an opening constructed to accommodate a pivot or pin 304 that passes through each arm 301, 303 and secures second end 258 of actuator 245 to actuator bracket 260. A key or cotter pin 309 secures pin 304 to arms 301, 303 with second end 258 of actuator 245 secured therebetween. When secured, operation of actuator 245 translates second end 258 of actuator 245 relative to actuator bracket 260.

Figure 9:
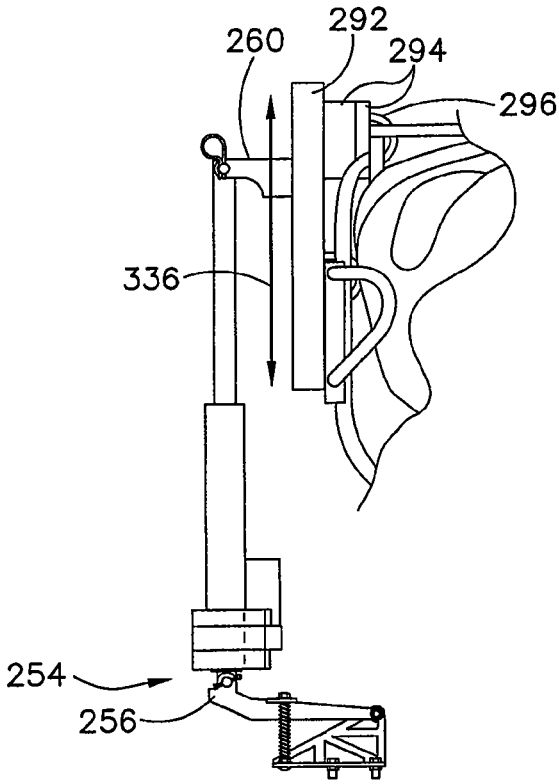
FIG. 9 is an elevational side view of a portion of the plowing system shown in FIG. 7.
Figure 10:
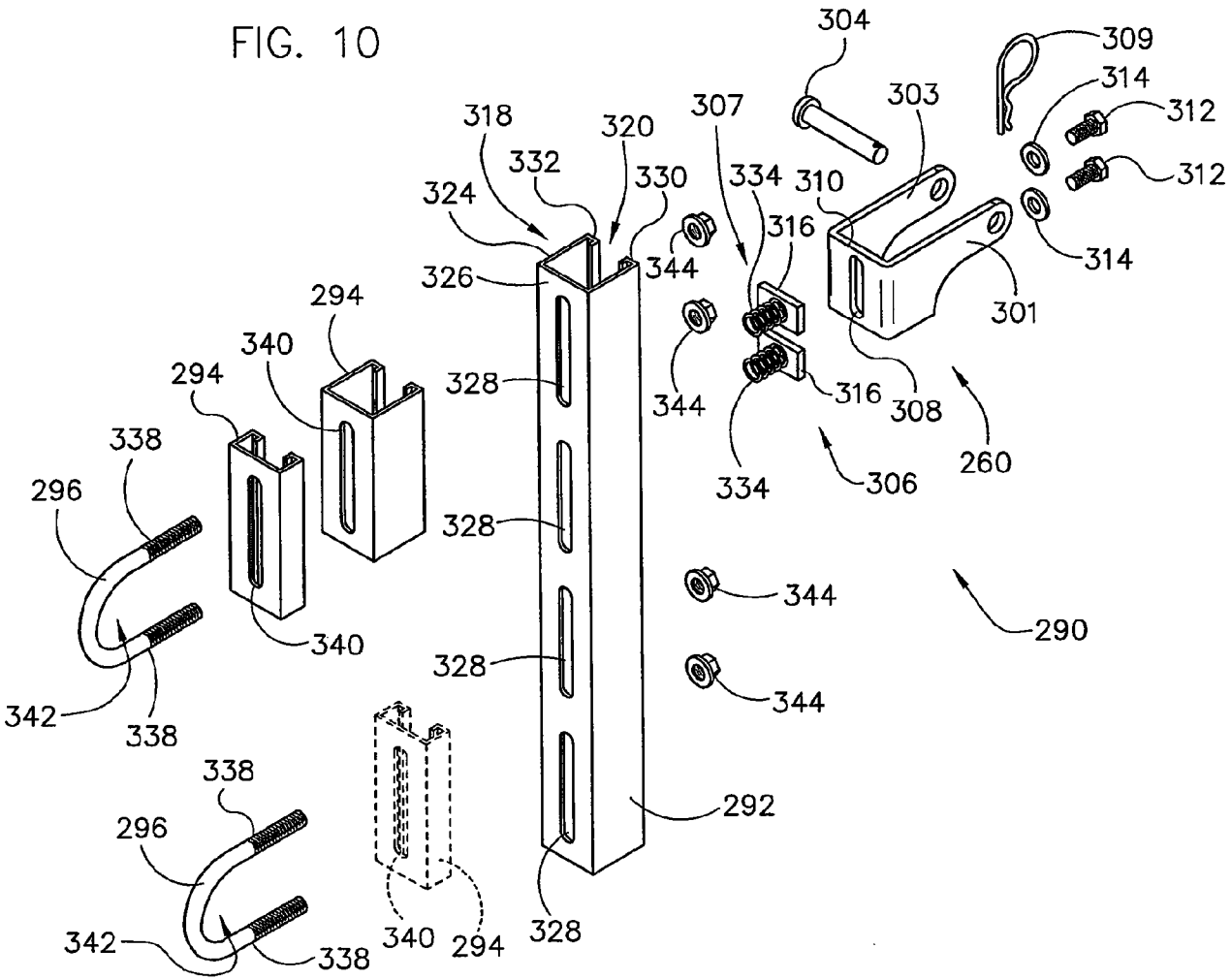
FIG. 10 is a perspective exploded view of an upper mount assembly of the plowing system shown in FIG. 7.

Referring to FIGS. 9 and 10, a slide assembly or spring clips 306, 307 secure actuator bracket 260 to rail 292. An opening or slot 308 is formed in a wall 310 of actuator bracket 260 that extends between arms 301, 303. A number of fasteners 312 and corresponding washers 314 pass through slot 308 and operatively engage a nut or plate 316 of each spring clip 306, 307. Rail 292 has a generally C-shaped cross-section 318 such that a channel 320 is formed between generally opposite facing walls 322, 324. A rear wall 326 extends between side walls 322, 324 and includes a plurality of openings or slots 328 formed therethrough and in fluid communication with channel 320. A rib or lip 330, 332 extends from an end of side walls 322, 324 oriented generally opposite rear wall 326. Each lip 330, 332 extends a length of rail 292 and inward over channel 320. Understandably, lips 330, 332 could be configured to extend only a portion of the length of rail 292 and could be configured to extend in directions other than over channel 320.

Channel 320 is constructed to slidably receive each spring clip 306, 307 such that a spring 334 of each spring clip 306, 307 biases plate 316 against lips 330, 332 when spring clips 306, 307 are disposed within channel 320. When assembled, lips 330, 332 are generally disposed between plates 316 and wall 310 of actuator bracket 260 such that tightening fasteners 312 generally fixes the position of actuator bracket 260 relative to rail 292. Plates 316 cooperate with channel 320 such that walls 322, 324 prevent rotation of plates 316 during manipulation of fasteners 312. Fasteners 312 can be loosened to allow translation of actuator bracket 260, indicated by arrow 336 in FIG. 9, along a length of rail 292 while fasteners 312 remain at least partially engaged with spring clips 307, 307. Such a construction provides a variable offset between second end 258 of actuator 245 relative to ATV 214. It is further envisioned that although two spring clips 306, 307 and fasteners 312 are shown, other numbers of sliding fasteners, such as one or more than two may be provided.

As shown in FIG. 10, each fastener 296 includes a pair of legs 338 that are constructed to cooperate with an opening or slot 340 formed through optional spacers 294 and engage one or more of slots 328 formed in rail 292. A gap or space 342 is formed between each leg 338 of fasteners 296 and is sized for receiving a portion of vehicle 214 therethrough. A number of nuts 344 are received in channel 320 of rail 292 and engage a respective leg 338 of each fastener 296. The generally U-shaped construction of fasteners 296 and the number of slots 328, 340 formed in rail 292 and/or optional spacer 294 allow rail 292 to be secured to ATV 214 at a variety of positions.

The independent positioning of rail 292 relative to ATV 214 and actuator bracket 260 relative to rail 292 allows upper mount assembly 290 to be configured for interaction with any of a number of vehicle constructions and orientations. Furthermore, upper mount assembly 290 is configured to allow rail 292 and actuator bracket 260 to be quickly and efficiently positioned, or repositioned, without removing rail 292 from vehicle 214 and/or actuator bracket 260 from rail 292, respectively. Accordingly, upper mount assembly is both easily configurable for different vehicles and conveniently configurable for the preference of particular users and/or applications. Additionally, such a construction allows plow system 210 to be configured for operation when the other systems of the ATV are reconfigured. For example, suspension components such as shocks, springs, or tires can be varied to achieve a desired ride or suspension configuration of the ATV and plow system 210 would still be operable with the ATV. Accordingly plowing system 210 is highly versatile and functional with ATV's constructed by different manufacturers and/or having different front end/frame assemblies, sub-assemblies as between different model years from a common manufacturer.

Figure 11:
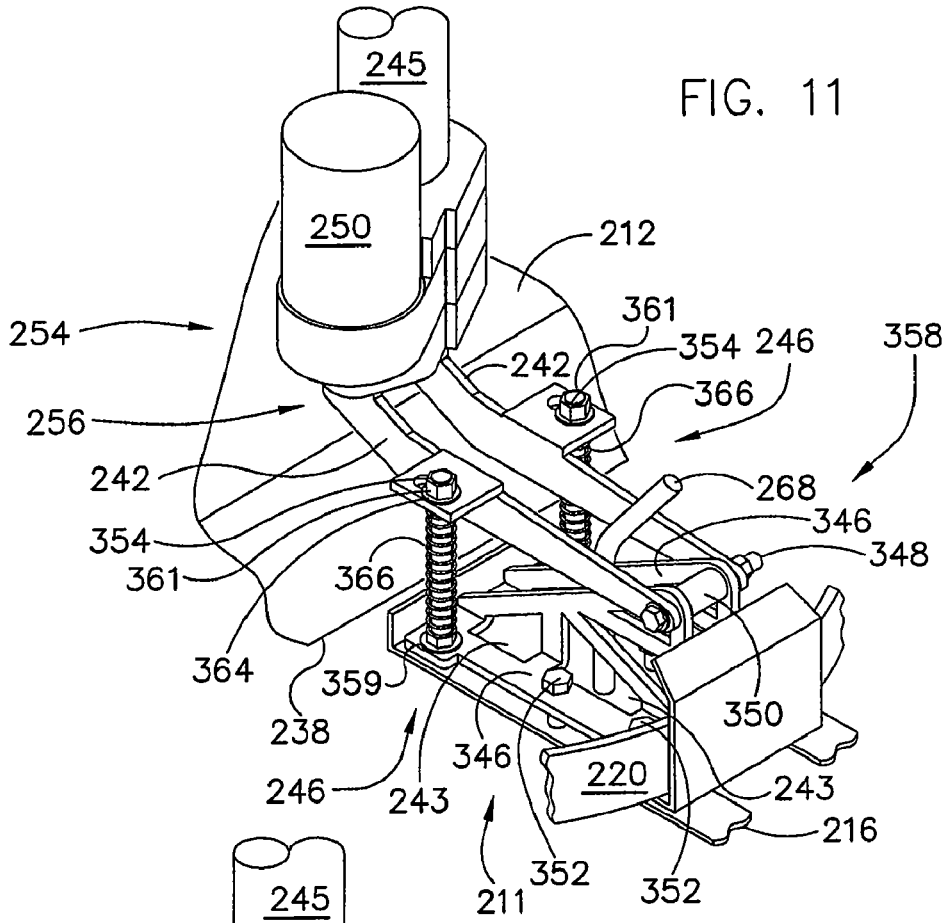
FIG. 11 is a perspective view of a shock arrestor of the plowing system shown in FIG. 9.
Figure 12:
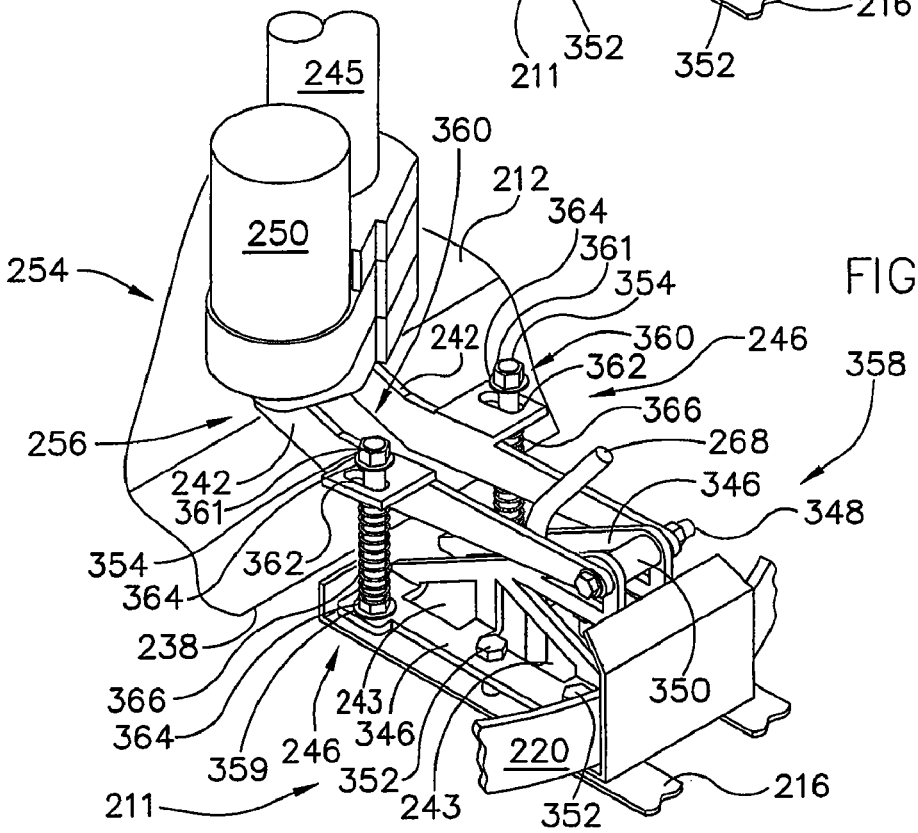
FIG. 12 is a perspective view similar to FIG. 11 with the shock arrestor deflected to an alternate position.

As shown in FIGS. 11 and 12, the construction and operation of shock arrestor 246 of plow system 210 is generally similar to the construction and operation of arrestor 46 of plow systems 10, 80. Third brackets 242 are pivotably attached to a pair of fourth, offset, or extension brackets 346 by a pin or fastener 348 that passes through an optional sleeve 350. A plurality of fasteners 352 pass through corresponding openings in extension brackets 346 and secure the extension brackets 346 to frame brackets 216. Extension brackets 346 allow third brackets 242 to move in a vertical plane relative to frame bracket 216. A number of passages 243 are formed through extension brackets 346 and reduce the capture of debris, such as snow, between the adjacently position extension brackets 346.

As shown in FIG. 11, arrestor 246 includes a support pin or pin 354, which extends between third brackets 242 and extension brackets 346. A first end 256 of each third bracket 242 is pivotably connected to first end 254 of actuator assembly 244 A second end 358 of each third bracket 242 is pivotably connected to lower mount assembly 211 via extension brackets 346. Each pin 354 of each arrestor 246 includes a first end 359 positioned proximate a respective extension bracket 346 and a second end 360 that passes through an opening 362 formed in a respective third bracket 242. A washer 364 is positioned proximate each end 358, 360 of each pin 354 and reduces damage to extension bracket 346 and/or third bracket 242 via engagement with head or nut portions 361 of the respective pins 354.

Referring to FIG. 11, when cutting edge 238 is lowered to a desired operating position or plow 212 is raised above a terrain, third brackets 242 are maintained in close proximity to first end 358 of arrestor 246 by the weight of plow 212 and by a spring 366. As shown in FIG. 12, when plow 212 encounters an obstruction during a plowing operation, plow bracket 220 deflects upwardly, thereby compressing spring 366 between plow bracket 220 and third brackets 242. As spring 366 is compressed between third brackets 242 and extension bracket 346, pin 354 translates through opening 362 of third bracket 242. As shown in FIGS. 11 and 12, pin 354 defines a maximum distance between third brackets 242 and frame bracket 216, and spring 366 defines a minimum distance therebetween. Accordingly, arrestor 246 allows plow 212 and plow bracket 220 to move independent of actuator 245.

Similar to plowing systems 10 and 80, plowing system 210 is constructed to reduce the impact of an obstruction that is translated through plowing system 210 to the frame of the ATV connected thereto. Similarly, when in a raised position, arrestor 246 dampens vibrational "bounce" of plow 212 as ATV 214 moves across uneven terrain. Such a construction minimizes the effects of plow bounce during non-operational transportation of the plow, as well as operational impacts subjected to the plow thereby reducing operator fatigue during a plowing process. Accordingly, arrestor 246 reduces the potential of damaging plow system 210, lower mount assembly 211, actuator assembly 244 upper mount assembly 290, or ATV 214 from plow impacts.

Each of plowing systems 10, 80, 210 reduces operator fatigue by limiting or wholly isolating occasional impacts subjected to the plow from being translated to the operator. Plow systems 10, 80, 210 are also applicable to a variety of vehicle platforms and constructions. Plowing systems 10, 80, 210 can be quickly and efficiently configured for operation with any of a number of vehicles as well as configured for individual operator preferences.

The present invention has been described in terms of various embodiments, and it is recognized that equivalents, alternatives and modifications, aside from those expressly stated, are possible and within the scope of the appending claims.

What is claimed is:

1. A plow mounting system comprising:

a frame bracket connectable to a vehicle body;

an actuator having an actuator first end connected to the frame bracket and an actuator second end;

an actuator bracket having a first end connected to the actuator second end so that the actuator extends between the frame bracket and the actuator bracket for altering the position of the frame bracket;

a mount bracket for being secured to a vehicle body in one of a plurality of positions and for engaging the actuator bracket at a plurality of positions independent of the position of the mount bracket relative to the vehicle body;

an offset bracket connected between the actuator first end and the frame bracket; and a shock arrestor connected to a plow bracket that is connected to the frame bracket and constructed to engage a plow blade, the shock arrester allowing the plow bracket to move independent of the actuator, the shock arrestor further comprising a support pin that defines a maximum distance between the offset bracket and the frame bracket and a spring that defines a minimum distance between the offset bracket and the frame bracket, the support pin extending between the frame bracket and the offset bracket and the spring being concentrically positioned on the pin.

2. The plow mounting system of claim 1 further comprising a motor connected to the actuator for controlling extension and retraction of a ram of the actuator.

3. The plow mounting system of claim 1 further comprising a pair of springs attached to the frame bracket and constructed to engage a plow attached thereto, the springs being disposed on generally opposite sides of the frame bracket.

4. The plow mounting system of claim 1 wherein the mount bracket has a generally U-shaped cross-section and the actuator bracket is constructed to engage an open end of the U-shaped cross-section.

5. The plow mounting system of claim 1 wherein the vehicle body is an all terrain vehicle.

6. A plow mount system adapted to attach a plow blade to an all terrain vehicle comprising:

a first bracket attachable to an off-road all terrain vehicle;

a second bracket that pivotably cooperates with the first bracket and extends in a forward direction relative to the first bracket and an all terrain vehicle, the second bracket configured to cooperate with an adjustable actuator having a variable length for altering a pitch of the second bracket relative to the first bracket during operation of the actuator, the actuator being a variable length electric ram that is powered by the power system of an underlying off-road all terrain vehicle;

a third bracket having a first side with a number of openings and that is constructed to face the vehicle when secured thereto and a pair of lateral sides extending from generally opposite ends of the first side, each lateral side having a lip for engaging a slide; and a plow bracket constructed to cooperate with a plow blade and pivotably connectable to the second bracket so that a pitch of the plow bracket relative to the second bracket about a substantially vertical axis can be selectively adjusted to alter an elevation of a plow blade.

7. The system of claim 6 further comprising an arrestor for dampening movement between the plow bracket and the first bracket.

8. The system of claim 7 wherein the arrestor further comprises a pin for attaching the second bracket and at least one of the first bracket and a fourth bracket for connecting to the first bracket and a plow and for allowing axial displacement therebetween and a spring for resisting the axial displacement.

9. The vehicle of claim 6 further comprising a motor attached to the actuator and connected to a power system of the all terrain vehicle for controlling a position of a ram of the actuator.

10. A plow mount system comprising:

a lower mount bracket assembly that includes a first bracket and a second bracket for connecting to one another providing a variable association therebetween so that, when the first bracket is engaged with an off-road all terrain vehicle, the second bracket achieves one of various positions relative to an all terrain vehicle when the first bracket and second bracket are engaged with one another and the first bracket is engaged with the off-road all terrain vehicle;

a third bracket pivotably connected to the second bracket at a position opposite the second bracket and constructed to support a plow blade at a position forward of the first, second, and third brackets;

an actuator having a first end for attaching the actuator to one of the first and second brackets and a ram for moving a second end of the actuator relative to the first end and attachable to structure other than the one of the first and second brackets at a position remote from the first end to alter an orientation of a plow blade attached to the third bracket relative to an underlying vehicle; and wherein the lower mount bracket assembly includes a fourth bracket that is pivotably connected to each of the second bracket and the first end of the actuator.

11. The plow mount system of claim 10 further comprising an absorber disposed between the fourth bracket and the second bracket and offset from a pivot connection therebetween.

12. The plow mount system of claim 11 wherein the absorber further comprises a pin that pass through the fourth bracket and a spring that is captured between the second bracket and the fourth bracket.

13. The plow mount system of claim 10 wherein the actuator is an electrical or mechanical actuator.

* * * * *